US007530204B2

(12) United States Patent
Cook et al.

(10) Patent No.: US 7,530,204 B2
(45) Date of Patent: May 12, 2009

(54) CLIMATE CONTROLLED HOUSING UNIT

(75) Inventors: Brent T. Cook, Salt Lake City, UT (US); Joseph B. Alexander, Salt Lake City, UT (US); Jorge G. Gatica, Eagle Mountain, UT (US)

(73) Assignee: Celestia, Salt Lake City, UT (US)

( * ) Notice: Subject to any disclaimer, the term of this patent is extended or adjusted under 35 U.S.C. 154(b) by 0 days.

(21) Appl. No.: 10/281,888

(22) Filed: Oct. 28, 2002

(65) Prior Publication Data

US 2003/0126814 A1 Jul. 10, 2003

Related U.S. Application Data

(60) Provisional application No. 60/345,385, filed on Oct. 26, 2001.

(51) Int. Cl.
*E04B 2/14* (2006.01)
*E04B 2/18* (2006.01)

(52) U.S. Cl. ..... 52/281; 52/271; 52/587.1; 52/268; 52/285.44; 52/404.3

(58) Field of Classification Search ..... 52/268, 52/267, 309.9, 272, 285.4, 404.3, 582.2, 52/282.3, 233, 281, 271, 582.1, 587.1; 312/400, 312/405, 406
See application file for complete search history.

(56) References Cited

U.S. PATENT DOCUMENTS 1,706,769 A * 3/1929 Buck ..... 52/404.4
2,127,111 A * 8/1938 Gaenzle ..... 52/404.4
2,485,646 A * 10/1949 Norquist ..... 220/592.27
2,870,857 A * 1/1959 Goldstein ..... 181/289
3,041,219 A * 6/1962 Steck ..... 428/138
3,078,003 A * 2/1963 Kesling ..... 220/592.1
3,113,401 A * 12/1963 Rose ..... 52/417
3,264,165 A * 8/1966 Stickel ..... 428/69
3,379,330 A * 4/1968 Perkins, Jr. ..... 220/560.13
3,512,819 A * 5/1970 Gillingwater et al. ..... 52/461
3,583,118 A * 6/1971 Lowery ..... 52/309.5
3,616,139 A * 10/1971 Jones ..... 428/118
3,665,662 A * 5/1972 Timbrook et al. ..... 52/210
3,786,613 A * 1/1974 Shepheard ..... 52/784.13
3,886,699 A * 6/1975 Bergmann, Jr. ..... 52/91.1
3,929,186 A * 12/1975 Becker ..... 165/49
4,021,981 A * 5/1977 Van Wagoner ..... 52/309.13
4,057,943 A * 11/1977 Lienhard ..... 52/126.6
4,201,903 A * 5/1980 Becker ..... 219/78.12
4,237,870 A * 12/1980 Wartes ..... 126/675
4,284,674 A * 8/1981 Sheptak ..... 428/69
4,300,882 A * 11/1981 Werych ..... 432/247
4,306,396 A * 12/1981 Iotti ..... 52/238.1

(Continued)

FOREIGN PATENT DOCUMENTS

FR 2338357 * 1/1976 ..... 52/268

*Primary Examiner*—Phi Dieu Tran A
(74) *Attorney, Agent, or Firm*—Kirton & McConkie; Michael F. Krieger

(57) ABSTRACT

A modular wall panel system to facilitate modular home construction in remote locations. Each wall panel includes two complementary wall members secured in their relative positions via a panel slide lock. Each wall member is composed of layers of lightweight, thermal resistant insulation. The insulant layers are separated by reflective layers designed to attract and retain solar energy.

15 Claims, 11 Drawing Sheets

U.S. PATENT DOCUMENTS 4,310,745 A * 1/1982 Bender ..... 219/213
4,453,357 A * 6/1984 Zwilgmeyer ..... 52/309.8
4,468,423 A * 8/1984 Hall ..... 428/72
4,516,374 A * 5/1985 Finney ..... 52/404.4
4,594,829 A * 6/1986 Herrgord ..... 52/282.3
4,662,288 A * 5/1987 Hastings et al. ..... 109/2
4,671,038 A * 6/1987 Porter ..... 52/586.1
4,696,138 A * 9/1987 Bullock ..... 52/404.3
4,726,974 A * 2/1988 Nowobilski et al. ..... 428/69
4,952,440 A * 8/1990 Sanmartin et al. ..... 428/116
4,974,382 A * 12/1990 Avellanet ..... 52/408
5,018,328 A * 5/1991 Cur et al. ..... 52/406.2
5,082,335 A * 1/1992 Cur et al. ..... 312/401
5,091,233 A * 2/1992 Kirby et al. ..... 428/69
5,135,073 A * 8/1992 Nelson ..... 181/290
5,157,893 A * 10/1992 Benson et al. ..... 52/789.1
5,270,092 A * 12/1993 Griffith et al. ..... 428/69
5,284,692 A * 2/1994 Bell ..... 428/69
5,345,738 A * 9/1994 Dimakis ..... 52/309.9
5,425,210 A * 6/1995 Zafir ..... 52/404.4
5,460,865 A * 10/1995 Tsotsis ..... 428/116
5,532,034 A * 7/1996 Kirby et al. ..... 428/69
5,628,158 A * 5/1997 Porter ..... 52/309.9
5,718,096 A * 2/1998 Nowara ..... 52/794.1
5,792,539 A * 8/1998 Hunter ..... 428/72
5,855,978 A * 1/1999 Handwerker ..... 428/57
5,890,785 A * 4/1999 Vismara ..... 312/406
6,006,481 A * 12/1999 Jacobs ..... 52/309.9
6,037,033 A * 3/2000 Hunter ..... 428/72
6,104,457 A * 8/2000 Izumi et al. ..... 349/73
6,153,135 A * 11/2000 Novitsky ..... 264/51
6,209,284 B1 * 4/2001 Porter ..... 52/794.1
6,217,140 B1 * 4/2001 Hirath et al. ..... 312/406
6,247,747 B1 * 6/2001 Kawanomoto et al. ..... 296/191
6,266,112 B1 * 7/2001 Mizobata et al. ..... 349/113
6,295,778 B1 * 10/2001 Burt ..... 52/592.6
6,358,599 B1 * 3/2002 Deibel et al. ..... 428/308.4
6,521,077 B1 * 2/2003 McGivern et al. ..... 156/304.1
6,860,082 B1 * 3/2005 Yamamoto et al. ..... 52/794.1

* cited by examiner

CLIMATE CONTROLLED HOUSING UNIT

RELATED APPLICATIONS

This application claims priority to U.S. Provisional Patent Application Ser. No. 60/345,385 filed Oct. 26, 2001, entitled CLIMATE CONTROLLED HOUSING UNIT.

BACKGROUND OF THE INVENTION

1. Field of the Invention

The present invention relates to a home construction system utilizing a modular panel system. More particularly, the present invention relates to a lightweight, easily transported, insulated modular panel system that utilizes solar energy to maintain a livable interior climate.

2. Background and Related Art

Prefabricated modular home construction is presently known in the art. Modular homes are designed, engineered, and built in a controlled environment. They are also easily disassembled, transported and re-built in different settings. The phrase, 'modular,' means the home is constructed with standardized units, allowing for flexibility and variety in use. This method of construction facilitates rapid completion, consistent quality, and affordability. Modular homes are typically more affordable than manufactured homes because of the minimal time, labor and resources required for on-site construction.

Most presently known methods of modular construction employ wall panels constructed of wood beams. Wood beam wall panels ensure structure stability in addition to facilitating thermal resistance through the use of insulation. The weight and bulk of such panels, however, render transportation and on-site erection of the structure awkward. For example, U.S. Pat. No. 6,244,016 (the "'016 patent") teaches a prefabricated wall panel composed of a frame constructed of wooden boards. The frame is interconnected via transverse spacing boards, held in place by nail plates. The art taught by the '016 patent improves upon the structure stability of the prior art. The '016 patent does not attempt to remedy the difficulty involved with transporting and erecting the disclosed wall system.

Lightweight modular wall panels are also well known in the art. Such wall panels typically utilize solid polyurethane foam, which form the core of each panel. The fundamental problem inherent in presently known lightweight modular wall panels is that polyurethane foam is not readily amenable to sub-contractor installations, such as electrical, plumbing and heating system installation. Indeed, such sub-contractors must use hot knives to create passageways through the wall panel's foam core to run piping or wiring.

In response to this problem, U.S. Pat. No. 5,765,330 (the "'330 patent") teaches a lightweight pre-insulated wall panel consisting of stud members inter-spaced between a top and bottom rail member. Foamed-in-place polyurethane covers a portion of each cavity between adjacent stud members. The layer of polyurethane foam has a thickness less than the depth of each cavity, thereby retaining within each cavity space for accommodating subcontractor installations.

As a result of its solution to the sub-contractor installation problem, the wall panel taught by the '330 patent fails to match the weightlessness of other lightweight wall panels known in the art. Indeed, the additional stud members required by the '330 patent nearly negate the primary purpose of utilizing polyurethane foam—weightlessness. Additionally, the '330 patent fails to remedy the problem of bulk encountered in the prior art.

Another problem inherent in presently known methods of modular construction is the system of tie-down anchors required to secure the wall panels to the ground. For example, U.S. Pat. No. 5,339,798 (the "'798 patent") discloses a modular home system wherein a system of anchors is required to stabilize the structure. Certain anchors extend from the floor panel to the earth beneath the floor panel. Others extend from the ground, over the roof area of the home, and back down to the opposite side of the home.

Such anchoring is undesirable for at least three reasons. First, additional materials, time and labor are needed to ensure effectiveness of the anchoring system. Second, such anchoring is likely to cause undesirable aesthetic effects. Finally, the process of stabilizing the anchoring system is fundamental to ensuring the safety of the structure. The combination of inevitable human error and unexpected weather phenomena is likely to compromise the effectiveness of the system, resulting in inadequate protection for future inhabitants. Accordingly, it would be an improvement in the art to augment or even replace current techniques with other techniques.

SUMMARY OF THE INVENTION

One object of some embodiments of the present invention is to remedy the problems of the prior art noted above, and specifically to provide an inexpensive modular housing system that is easily transported, erected, and effectively secured.

Another object of some embodiments of the present invention is to provide a modular housing system with a high degree of thermal resistance, which can maintain a livable climate within the housing system.

Additional objects and advantages of some embodiments of the present invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, some embodiments provide for a modular housing system utilizing a wall panel system. In one implementation, each wall panel includes two complementary wall members. One wall member is secured to the ground via an anchoring system extending beneath the earth's surface. The wall member includes several layers of lightweight, thermal resistant insulation. The insulating layers are separated by reflective layers designed to repel solar energy on the outside, while retaining internal energy on the inside.

A complementary wall member, substantially similar in composition to the primary wall member, is affixed to the top edge of the primary wall member. The complementary shapes of the two wall members ensure maximum stability between the two. The wall members are secured in their relative positions via a panel slide lock, which attaches to intermediary adjoining surfaces of each wall member and extends the entire length of the resulting wall panel.

In at least one implementation of the present invention, a vacuum encapsulation in the panel as well as the reflective materials stops the conductive heat gain caused by oxygen in the building system. The radian heat gain is stopped by the reflective nature of the materials used. A climate controlled shield encapsulated vacuum prevents the heat and cold from crossing the shield, because oxygen transfers heat and cold. The shield is in place and stops the transfer. The outside is polypropylene, dyed and UV protected. The next layer is polyethylene, which on the outer side is bounded by Kevlar, and on the inner side is bonded with reflective foil. The next layer is a panel treated to prevent oxygen from penetrating, and is sealed by an oxygen proof material creating the vacuum. An inside layer is a thin layer of polypropylene.

As provided above, these and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

As used in this specification, the term modular housing unit refers to the system of adjoining wall panels, floor systems, roof panels and trusses described herein.

The modular housing unit of some embodiments of the present invention is designed to facilitate the transportation and assembly of habitable (or in some instances, uninhabitable), energy-efficient structures to impoverished foreign nations and to victims of natural disaster. Specifically, the modular housing unit described herein discloses specially designed, energy efficient, and lightweight wall panels capable of easy assembly and disassembly.

According to one aspect of some embodiments of the present invention, each wall panel is provided with means for facilitating its assembly and disassembly. By way of example and not limitation, the facilitating means of the embodiment of the joined wall panel (36) illustrated in FIG. 3 comprise generally a top wall member (32) having a face, sides and ends as seen in FIG. 1, a bottom wall member (34) having a face, sides and ends as seen in FIG. 2, and a panel slide lock (30), illustrated in FIG. 3, for securing the top wall member (32) of FIG. 1 upon the bottom wall member (34) of FIG. 2.

Figure 2:
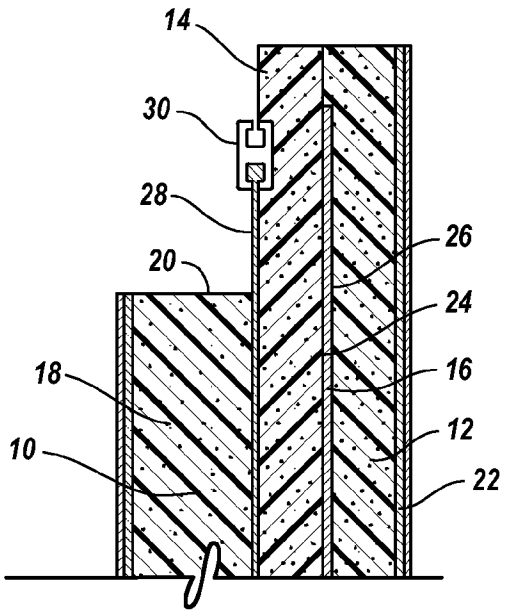
FIG. 2 illustrates a side perspective view of a bottom wall member of a preferred embodiment of the present invention.
Figure 1:
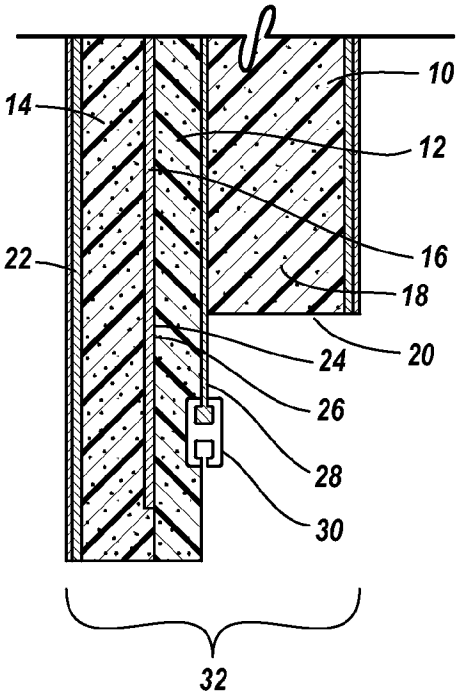
FIG. 1 illustrates a side perspective view of a top wall member of a preferred embodiment of the present invention, showing both insulating means and a panel slide lock.

According to another aspect of some embodiments of the present invention, the bottom wall member (34) of FIG. 2 is substantially identical to the top wall member (32) of FIG. 1.

One presently preferred embodiment of the top wall member (32) of FIG. 1 comprises a first insulant layer (10) having a face, sides and ends, a second insulant layer (12) having a face, sides and ends, and a third insulant layer (14) having a face, sides and ends.

In a presently preferred embodiment of the top wall member (32), each insulant (hereinafter also referred to as "insulation") layer (10, 12, 14) comprises high-density rigid-board insulation. Each insulant layer (10, 12, 14) extends to a substantially equal depth. The width of each end of the first insulant layer (10), however, is substantially greater than the ends of each of the other insulant layers. The length of each side of the first insulant layer (10) is substantially less than the corresponding side length of either of the other insulant layers. The relative dimensions of the several insulant layers result in a substantially L-shaped top wall member (32). The top wall member's (32) L-shape facilitates a stable relationship between the top wall member (32) and a substantially identical bottom wall member (34) upon assembly.

According to another aspect of some embodiments of the present invention, the top wall member (32) provides means for maximizing the thermal retention of the insulating layers (10, 12, 14) on the inside of the house. Conversely, on the exterior of the house, top wall member (32) maximizes means for repelling the sun's energy. By way of example and not limitation, thermal retention maximizing means comprise generally a reflective layer (16) and reflective insulation (26) for repelling solar energy on the exterior, and a vacuum chamber (18), divider (20). Thermal break spacers (24) are provided for retaining such energy on the interior.

Figure 3:
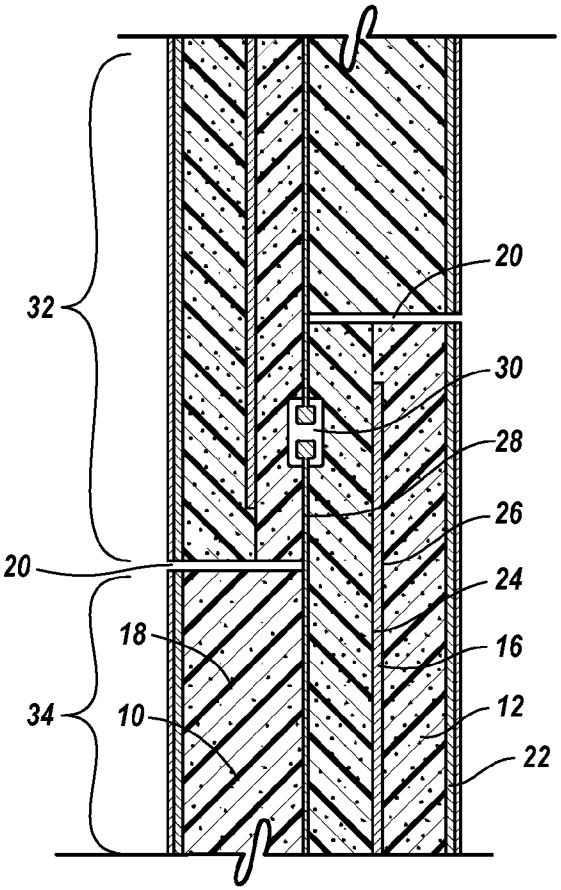
FIG. 3 illustrates a side perspective view of joined wall members of a preferred embodiment of the invention, which roughly corresponds to the side perspective views of FIGS. 1 and 2.

By way of example and not limitation, one presently preferred embodiment of the wall panel system (36) is depicted in FIG. 3. It comprises an upper wall member (32) and a lower wall member (34). The outer layer of each wall member is fiber reinforced plastic (22). The layer immediately beneath the fiber reinforced plastic layer is the third insulant layer (14), which comprises dense rigid-board insulation. This third insulation layer (14) attaches to the inner surface of the fiber reinforced plastic layer (22). Beneath and bonded to the third insulation layer (14) is first, a heavy reflective foil layer (16) and second, a reflective insulation (26) layer. Beneath and bonded to this reflective foil layer (16) and reflective insulation (26) layer is the second insulant layer (12) comprising dense rigid-board insulation. The cloth stress panel (28) lies beneath and is bonded to the second insulant layer (12) in the concise middle of the panel, serving as the structural stress support for the panel. Beneath and bonded to the cloth stress panel (28) is the first insulant layer (10) comprising a vacuum chamber (18) held apart by thermal break spacers (24) that enable the chamber to retain its structure while a vacuum force is in effect. Wall members and wall panels are separated by a divider (20) and are connected through the cloth stress panel (28), which is connected to the cloth stress panel of other member(s) (32, 34) or panel(s) (36) two-dimensionally by a slide lock (30).

Figure 2A:
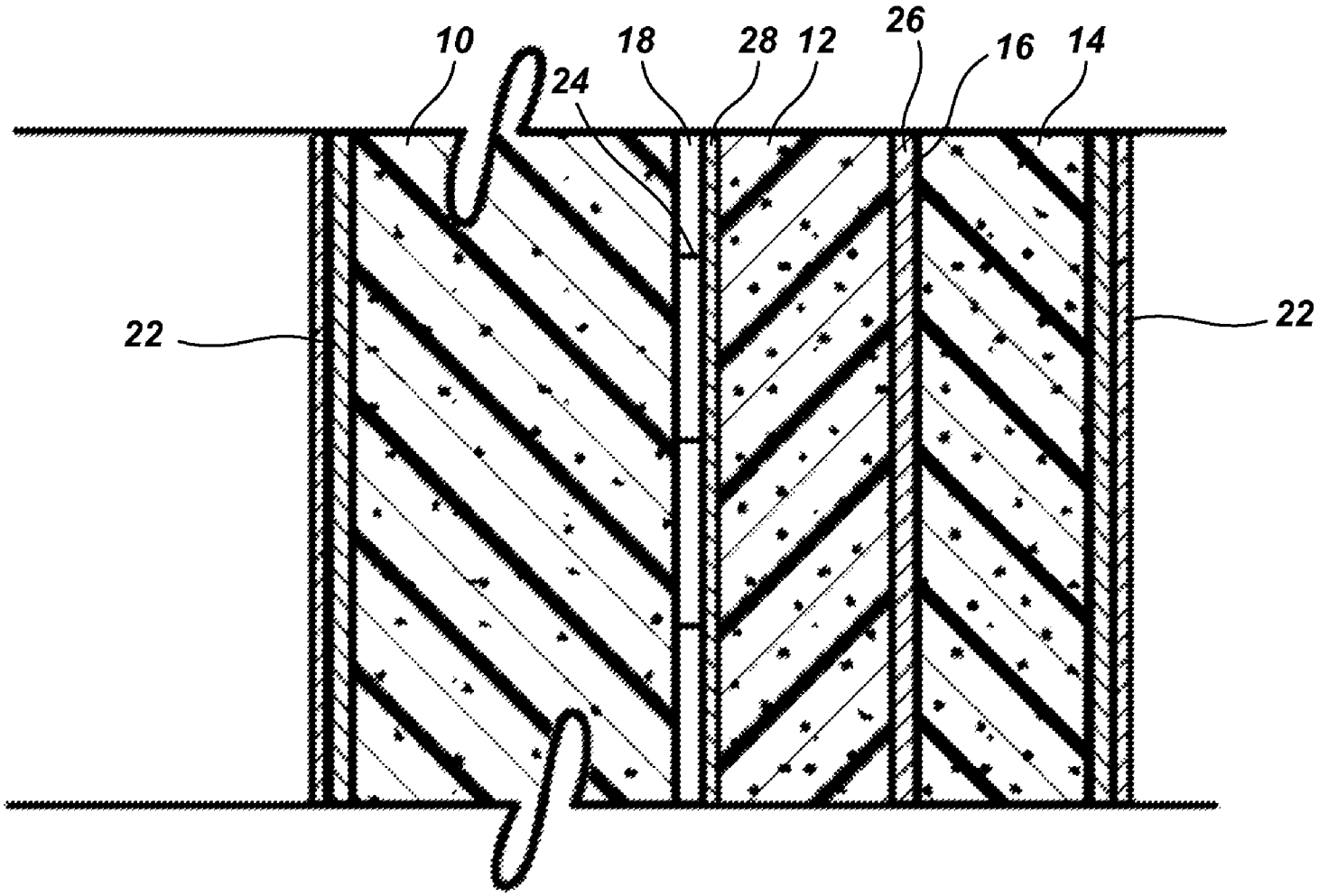
FIG. 2A illustrates an enlarged side perspective view of FIG. 2, a bottom wall member of a preferred embodiment of the invention.
Figure 5:
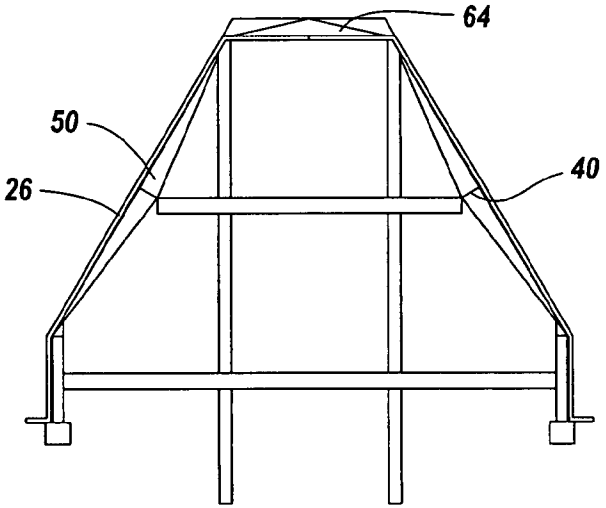
FIG. 5 illustrates a front sectional view of a preferred embodiment of the present invention.
Figure 6:
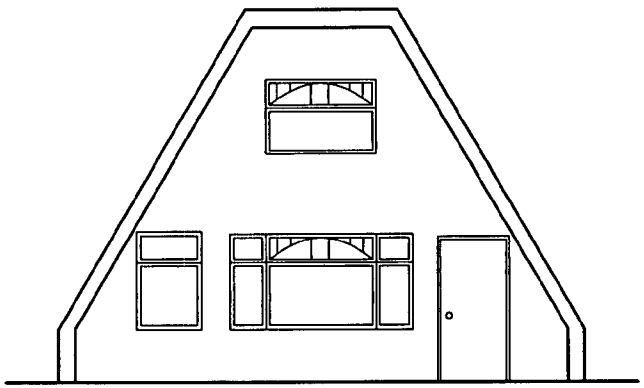
FIG. 6 illustrates a front perspective view of a preferred embodiment of the present invention, which corresponds to the front sectional view of FIG. 5.
Figure 4:
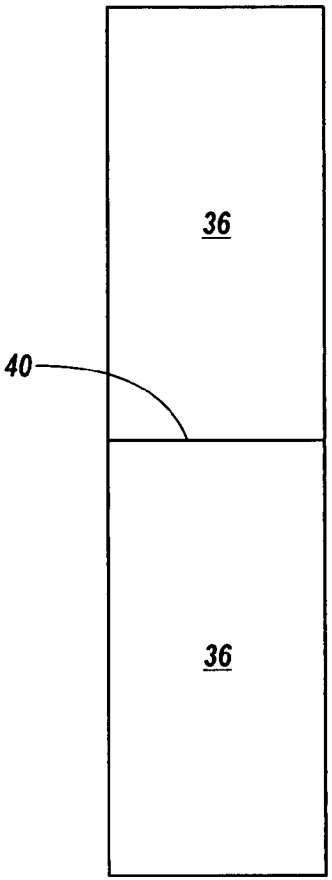
FIG. 4 illustrates a front perspective view of a seam resulting from the juncture of two wall members of the embodiment depicted by FIG. 3.
Figure 7C:
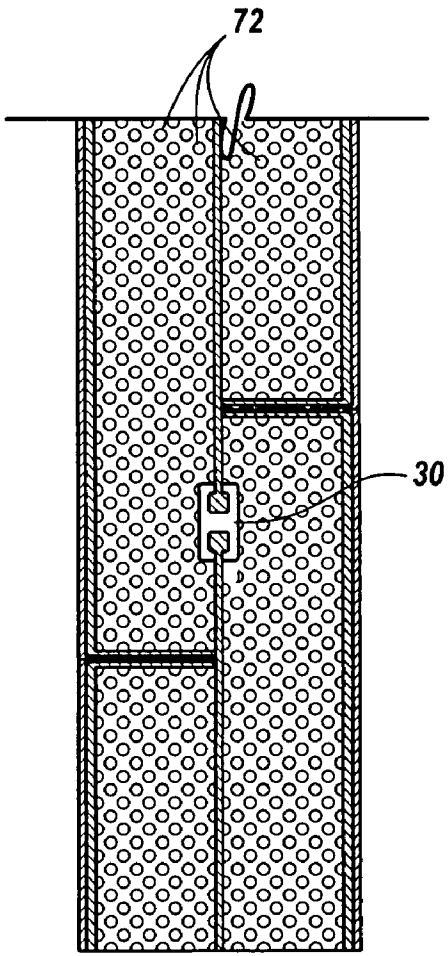
FIG. 7 illustrates materials used in the climate controlled shield panel, and illustrates a joining together of panels to make one structure, wherein components of the panel are the same except where a triangulation of the roof requires its own shape for the slope of the roof, and wherein a slide lock permits ease of assembly because the panels remain in their fixed locations.
Figure 7D:
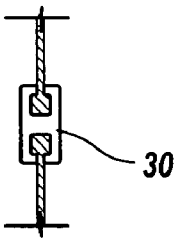
Figure 7B:
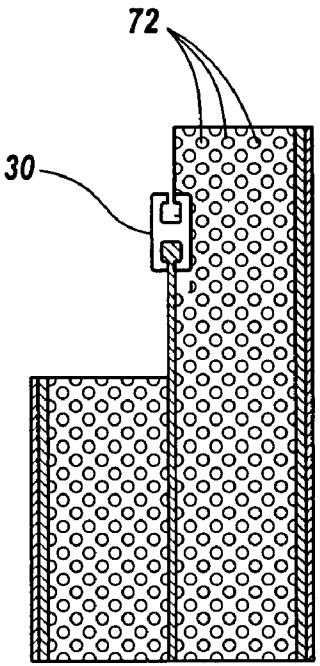
Figure 7A:
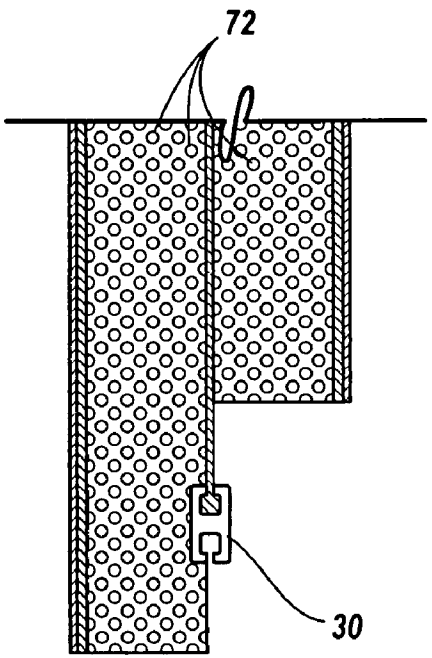
Figure 8:
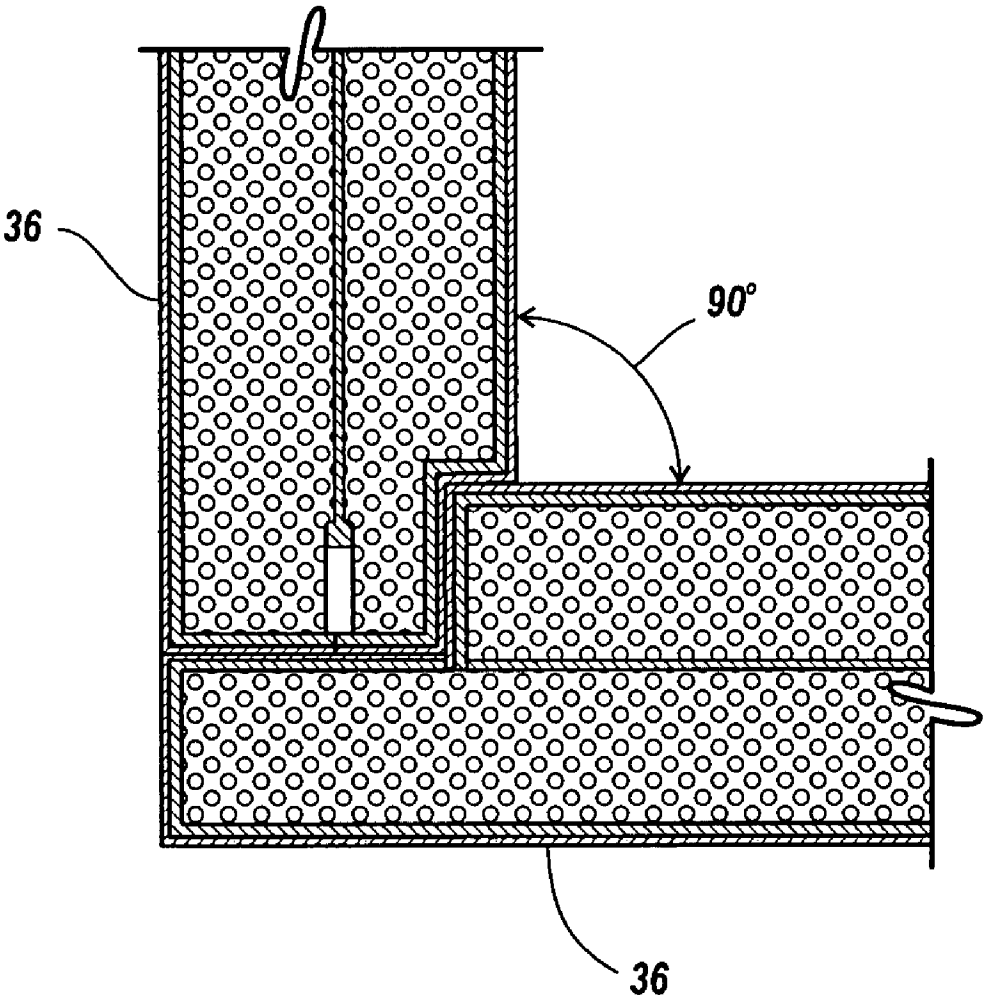
FIG. 8 illustrates how wall panels intersect at wall corners at a 90-degree angle.
Figure 9:
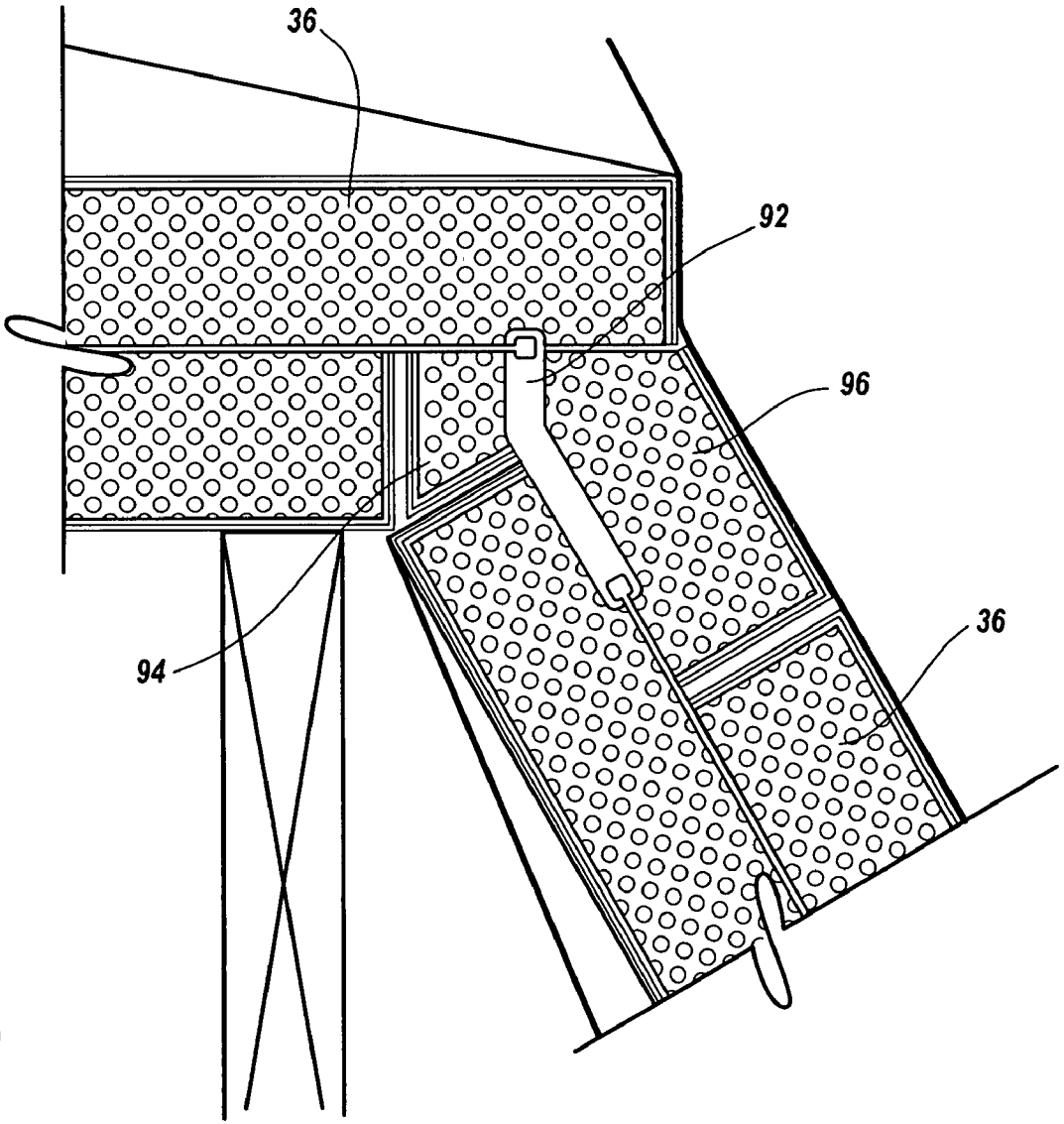
FIG. 9 illustrates connections at a roof and a wall at 60-degree angles for housing.
Figure 10:
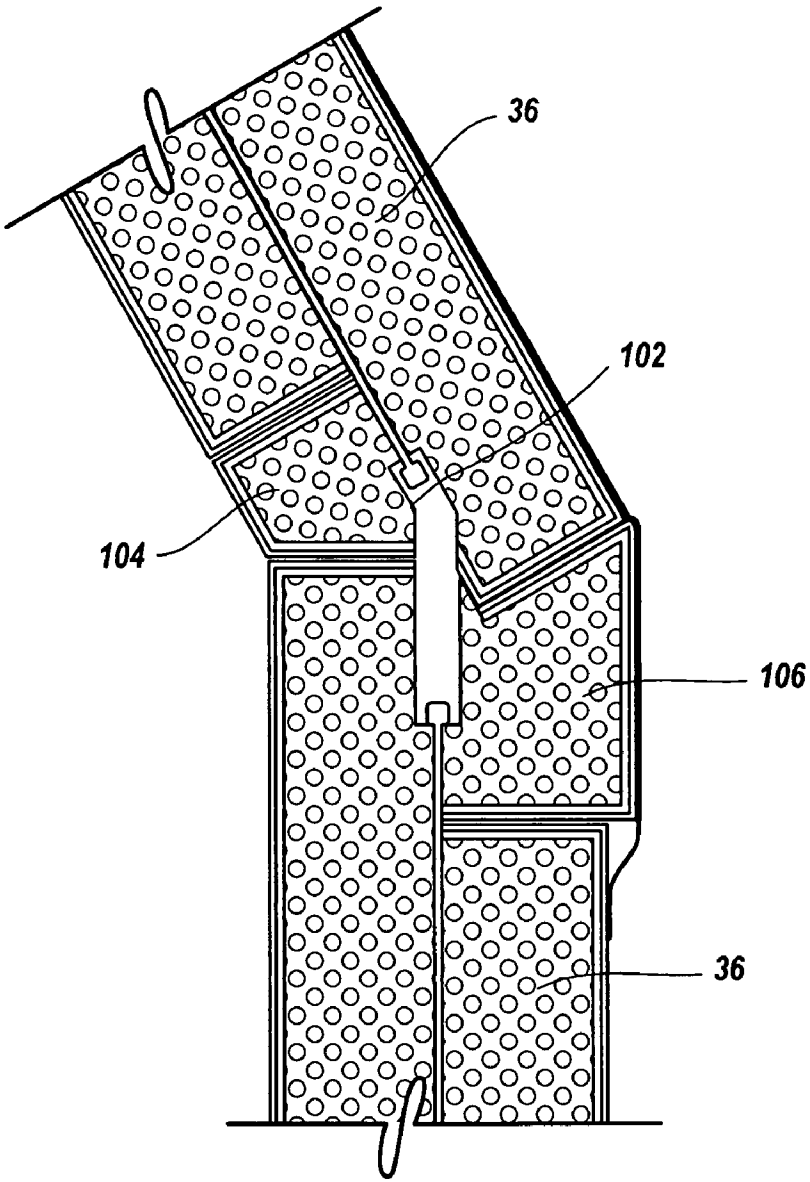
FIG. 10 illustrates an intersection of the bottom of the roof and the wall for housing.
Figure 11:
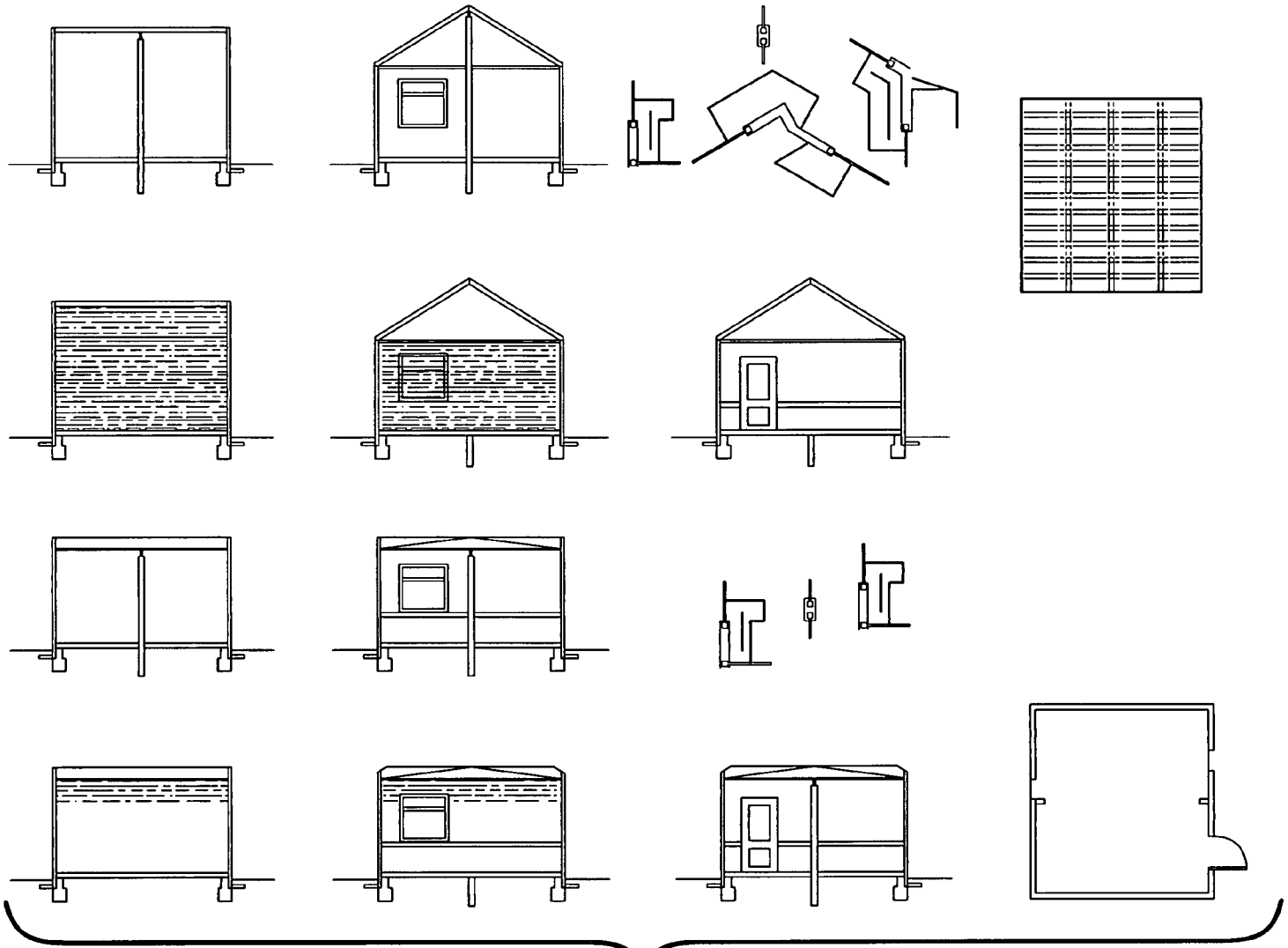
FIG. 11 illustrates a home for disadvantage people of the world, illustrating a side view of the shield lock. The floor will be textured polypropylene with a non-slip surface. The roof is structured according to climatic conditions.
Figure 12:
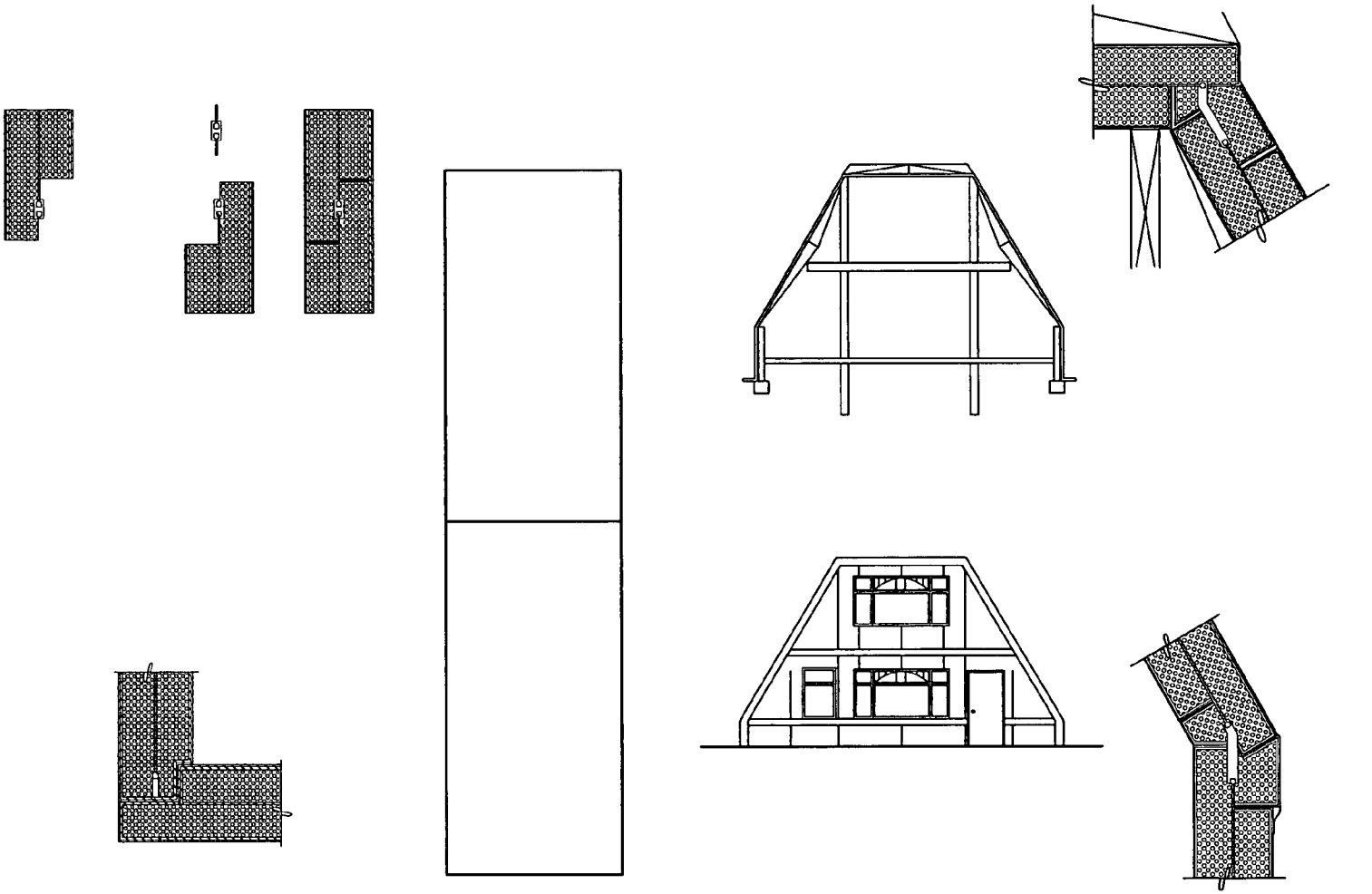
FIG. 12 illustrates a possibility of building a home in America. We hope to further design this home and also use our paneling on existing homes to replace vinyl sliding, as a superior insulated home.
Figure 13:
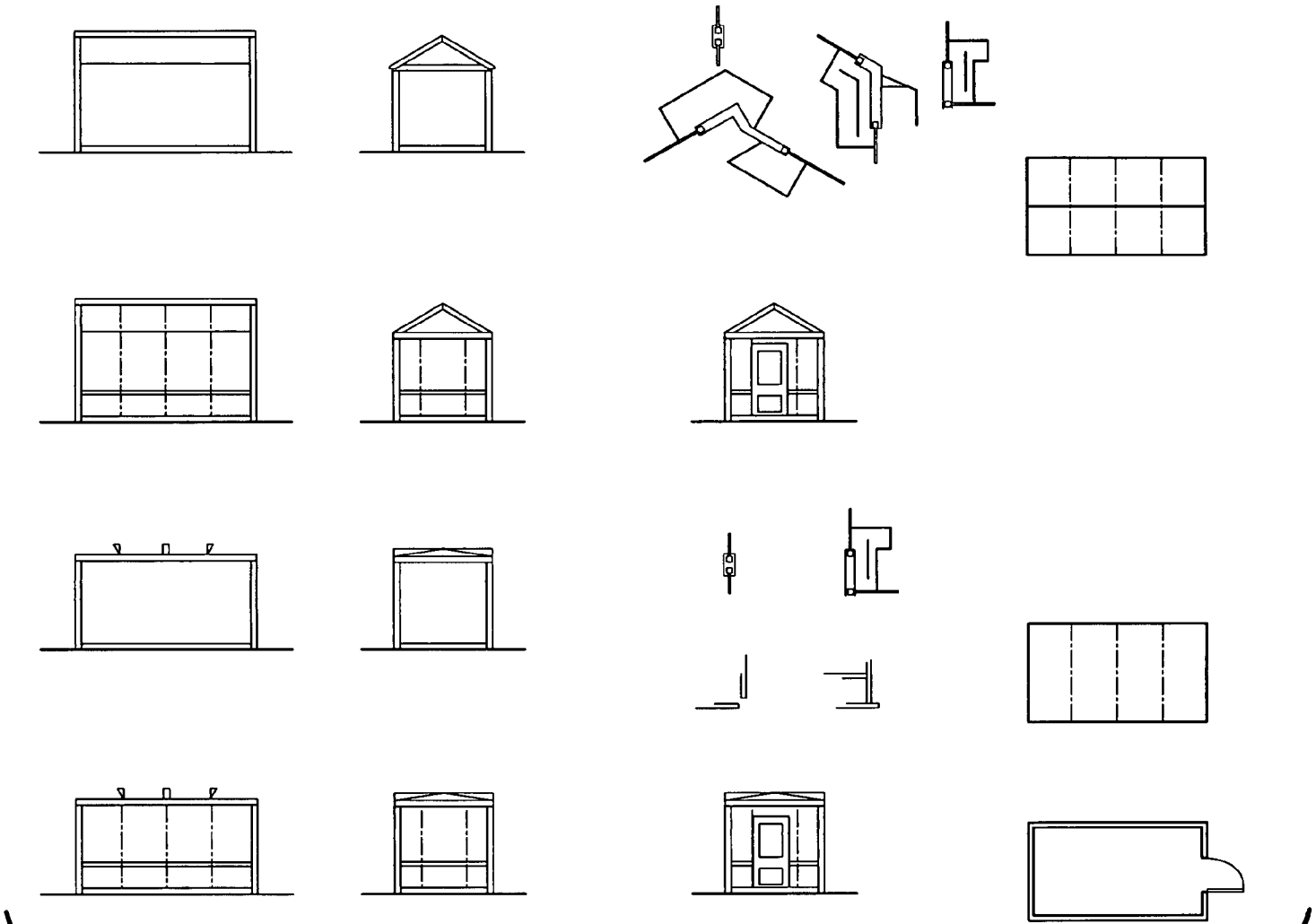
FIG. 13 illustrates a storage shed with different models based on temperature demands externally on a shed, such as snow, wherein a roof plan is provided according to an external temperature demand.
Figure 14:
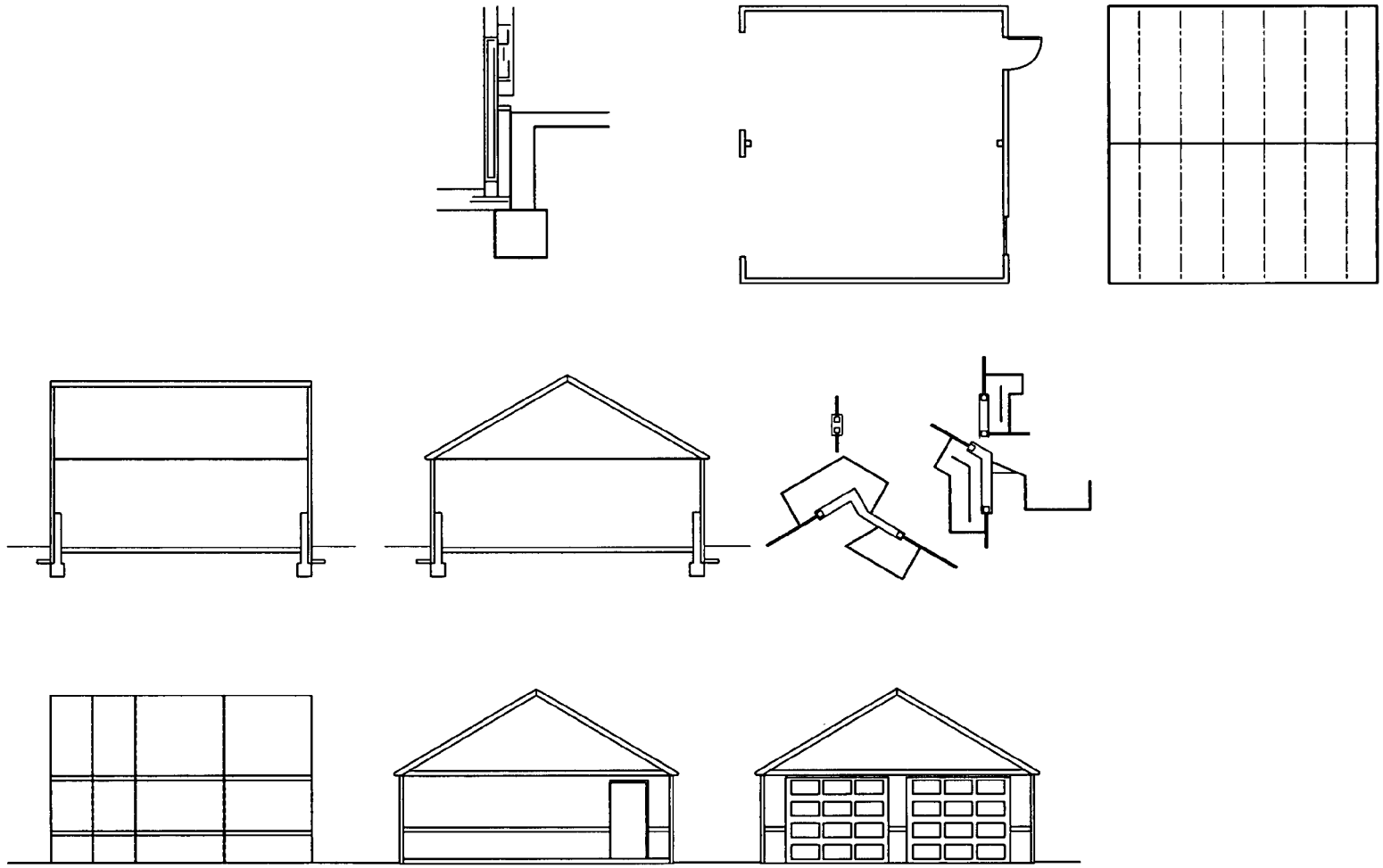
FIG. 14 illustrates a garage.

As an overview, and with reference to FIG. 2A, which illustrates an enlarged side perspective view of a section of a bottom wall member of an embodiment of the invention similar to FIG. 2, in one presently preferred embodiment, the outer layer of either the top wall member (32) or the bottom wall member (34) is fiber reinforced plastic (22). The panel is a molded panel that is heat-welded at all joints. The fiber reinforcement protects the exterior skin so that it is resistant to heat, typhoons, hurricanes, and other climate conditions. This also makes the panel impervious to humidity and flooding; the inner vacuum bladder being the most resistant of all. The panel is earthquake proof because of the fibers in the fiber reinforced plastic layer (22) on both the exterior and interior skins. The panels are like vinyl window frames with a bonded attachment to the fiber reinforced plastic layer (22). These fiber reinforced plastic layers (22) with the Kevlar-type cloth stress panel (28) are the shear diaphragms in each panel.

Moreover, the exterior surface consists of a paintable surface that may be covered with small indentations. These indentations facilitate solid mechanical attachment with special fire resistant plaster. The fire resistant plaster, along with the cloth stress panel (28), make the entire panel fire resistant. As seen in FIG. 2A, the layer immediately beneath the fiber reinforced plastic layer (22) is the third insulant layer (14), which comprises dense rigid-board insulation. This third insulation layer (14) attaches to the inner layer of the fiber reinforced plastic layer (22). Beneath and bonded to the third insulation layer (14) is first, a heavy reflective foil layer (16) and second, a reflective insulation (26) layer. Beneath and bonded to this reflective foil layer (16) and reflective insulation (26) layer is a second insulant layer (12). Beneath and bonded to the second insulant layer (12) is a vacuum chamber (18). Thermal break spacers (24) hold the vacuum chamber apart, enabling the chamber to retain its structure while a vacuum force is in effect. Finally, the cloth stress panel (28) lies in the concise middle of the panel; that is, between the second insulant layer (12) and the vacuum chamber (18), and serves as the structural stress support for the panel. The cloth stress panel (28) is connected two-dimensionally, panel to panel, by a slide lock (30). The slide lock (30) interlocks, one with another, where the top wall member 32 and the bottom wall member (36) connect, as illustrated in FIG. 3, (36). The cloth stress panel (28) is the waterproofing membrane of the structure and as mentioned above, is the structural reinforcement for the entire system.

Thus, more specifically, in one presently preferred embodiment of the reflective layer (16), the reflective layer comprises aluminum polyester film. In one presently preferred embodiment of the reflective insulation (26), the reflective insulation (26) (vacuum bladder) comprises foil-faced polyisocyanurate, wherein aluminum polyester film is bonded to the foil face.

In one presently preferred embodiment of the divider (20), the divider (20) comprises a vinyl window-like frame for preventing the transfer of thermal energy absorbed inside and retained by the insulant layers (10, 12, 14) (yet repelled by the outside layers) of the top wall member (32) to the insulant layers (10, 12, 14) of the bottom wall member (34) when the joined wall panel (36) is fully assembled.

In one presently preferred embodiment of the thermal break spacers (24), the thermal break spacers (24) comprise a thermal break for preventing the transfer of thermal energy retained by one insulant layer to an adjacent insulant layer.

According to another aspect of the present invention, the top wall member (32) provides means for retaining its shape and for preventing damage to its internal layers. By way of example and not limitation, retaining means comprise generally a fiber reinforced plastic (22) layer and the cloth stress panel (28).

In one presently preferred embodiment, the reinforced plastic (22) layer is adherent to the laterally exposed sides of the first insulant layer (10) and the third insulant layer (14).

In one presently preferred embodiment of cloth stress panel (28) is confined between the first insulant layer (10) and the second insulant layer (12).

According to another aspect of the present invention, the top wall member (32) of FIG. 1 provides means for securing the top wall member (32) upon the bottom wall member (34) of FIG. 2 and for preventing relative movement between the two wall members. By way of example and not limitation, securing means comprise a panel slide lock (30) having a face, sides, and ends. Upon engagement of the top wall member (32) with the bottom wall member (34), the panel slide lock (30) is capable of insertion between the top wall member (32) and the bottom wall member (34) such that the panel slide lock (30) extends the entire depth of the resulting joined panel (36) of FIG. 3.

One side of the panel slide lock (30) engages the exposed lateral edge of the top wall member's (32) second insulant layer (12), while the opposite side of the panel slide lock (30) engages the exposed lateral edge of the bottom wall member's (34) second insulant layer (12). The face of the panel slide lock (30) is retained at a position substantially commensurate with the faces of the wall member's insulant layers (10, 12, 14).

Additionally, in some embodiments of the present invention, the slide locks (30) are all vacuum-insulated, which provides 'thermal breaks' to the system. Moreover, horizontal slide locks (30) may be small and rectangular and interlock the vertical joints at the panel corners. Vertical slide locks (30) are structural channels. Slide locks used on the roof (64) of the system are triangular.

Furthermore, in some embodiments of the present invention, aesthetic, decorative, functional and educational features are provided. For instance, with respect to an inhabitant's educational needs, inner walls of the joined panels of the housing system may have on them static cling wallpaper displaying important information about education or hygiene that can be updated and changed as the person living within the system incorporates the information and progresses to different levels. Specifically, certain hygiene tips may be provided, such as a suggestion for washing hands before all meals, and then replaced with a different tip as the person learning the information assimilates and uses the information.

Also, with respect to aesthetic and decorative features, windows and doors may be incorporated into the system. The windows and doors may be cast into a concrete stem wall that serves as the foundation for the entire system. The concrete stem wall may serve as a heat sink in the winter, and a cooling reservoir in the summer. It may also serve as a protection barrier, guarding against outside elements. Finally, with respect to functional features, the panels may all have receptacles for easy implementation of any electrical, mechanical or plumbing fixture.

In one embodiment, renewable organic materials such as chitosen, whey or wheat gluten are held together by cellulose fibers to produce gas-proof packaging for a vacuum encapsulate of wall section. Under the skin material, type two PET (polyethelene terecphalon) plastic bubbles surrounded by an oxygen reducing agent are arranged. An oxygen removal agent may be introduced to remove any remaining oxygen and form a vacuum. Dacron may be used to separate bubbles.

Accordingly, those skilled in the art will appreciate the advantages of the climate controlled shield panel. The materials are user friendly using plastic instead of wood for the designed structures, thus trees would not have to be cut down to support our structures, which would support our ecosystem. The structures designed would be easily assembled using the shield lock, as one would simply slide the panel walls together and lock them in place. A variety of products can be made from the one panel design. Wood framing is time consuming and labor intensive, and it would be cost effective to have a ready to go panel, especially for those that do not have the time or expertise to build themselves. Due to the design there would be a greatly improved insulation value due to the vacuum encapsulation, preventing hot and cold air from penetrating into the inside of the structure.

In one embodiment improved a structural heat shield that is composed of non-thermally conductive plastic with a thermal brake is placed between the two inside layers of the vacuum bladder seal. It is filled with air to level bladder with top of heat shield. DD Fiber reinforcing heat side. Mirrored sides configured to focus all heat radiation back out in the direction that is comes from.

In one embodiment, a reinforcing includes a graphite wrap sharpened fiber reinforcing, which does not wrinkle an inner fill of the density structural foam. This foam has high bonding capacity with vacuum exterior graphite wrap has separators. The outer layer is powered poured at the same time. A layer may be bonded to the foam to provide a highly insulated structural panel one-piece technology with total sealing of the panel. Moisture infiltration is vacuum bonded to mold of individual people's group identity requirements. A vacuum bladder then has the air let out and a vacuum is made through a reverse angle valve for placing this vacuum operational.

In one embodiment, a window has the properties that when the sun or heat source hitsthe window between panels, a gas changes an interior environment and acts as a filter for the bright sun.

Thus, as discussed herein, the embodiments of the present invention embrace systems and methods that relate to a home construction system utilizing a modular panel system. More particularly, embodiments of the present invention relates to a lightweight, easily transported, insulated modular panel system that utilizes solar energy to maintain a livable interior climate. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A modular wall panel system, comprising:

a prefabricated wall panel for installation having a plurality of wall members, wherein each wall member includes a face, sides, and ends;

said prefabricated wall panel comprising a top wall member secured upon a bottom wall member by a slide lock and separated by a divider, each of said top and bottom wall members further comprising:

a first insulant layer;

a vacuum chamber bonded to the first insulant layer;

a cloth stress panel bonded to the vacuum chamber;

a second insulant layer bonded to the cloth stress panel;

a reflective layer and a reflective insulation layer bonded between the second insulant layer and a third insulant layer;

said third insulant layer; and an outer fiber reinforced plastic layer bonded to said third insulant layer;

said slide lock comprising a pair of c-shaped openings to receive said cloth stress panels and connecting said cloth stress panel of said top wall member to said cloth stress panel of said bottom wall member; and means for connecting the wall panel to another wall panel.

2. A modular wall panel system as in claim 1, wherein the system is configured for use as a climate controlled storage shed.

3. A modular wall panel system as in claim 1, wherein the system is configured for use as a climate controlled garage.

4. A modular wall panel system as in claim 1, wherein the system is configured for use as a skylight cover.

5. A modular wall panel system as in claim 1, wherein the system is configured for use in a cooler.

6. A modular wall panel system as in claim 1, wherein the system is configured for use in a refrigerated truck.

7. A modular wall panel system as in claim 1, wherein the system is configured for use in a doghouse.

8. A modular wall panel system as in claim 1, wherein the system is configured for use in a car.

9. A modular wall panel system as in claim 1, wherein the system is configured for use in a tree house.

10. A modular wall panel system as in claim 1, wherein the system is configured for use in a mobile motor home.

11. A modular wall panel system as in claim 1, wherein the system is configured for use in a barn.

12. A modular wall panel system as in claim 1, wherein the system is configured for use in a sound roofing application.

13. A modular wall panel system as in claim 1, wherein the system is configured for use in a rocket part.

14. A modular wall panel system as in claim 1, wherein the system is configured for use in an airplane.

15. A modular wall panel system as in claim 1, wherein the system is configured for use in a train.

* * * * *